US005146821A

United States Patent [19]

Bruder et al.

[11] Patent Number: 5,146,821

[45] Date of Patent: Sep. 15, 1992

[54] METHOD OF CUTTING BLANKS FROM WEBS OF MATERIAL

[75] Inventors: Wolfgang Bruder, Bielefeld; Klaus Biervert, Spenge; Jürgen Meybrink, Gutersloh, all of Fed. Rep. of Germany

[73] Assignee: Dürkopp Adler AG, Fed. Rep. of Germany

[21] Appl. No.: 618,661

[22] Filed: Nov. 27, 1990

Related U.S. Application Data

[63] Continuation-in-part of Ser. No. 274,460, Nov. 21, 1988, Pat. No. 4,972,745.

[30] Foreign Application Priority Data

Nov. 19, 1987 [DE] Fed. Rep. of Germany ..... 3739201

[51] Int. Cl.[5] ..... B26D 3/00

[52] U.S. Cl. ..... 83/40; 83/56; 83/937

[58] Field of Search ..... 83/55, 56, 39, 40, 48, 83/937, 943

[56] References Cited

U.S. PATENT DOCUMENTS

| | | | |
|---|---|---|---|
| 3,245,295 | 4/1966 | Mueller | 83/56 |
| 3,766,813 | 10/1973 | Pearl | 83/56 |
| 3,768,347 | 10/1973 | Wade et al. | 83/937 |
| 3,803,960 | 4/1974 | Pearl et al. | 83/56 |
| 3,826,170 | 7/1974 | Jones et al. | 83/937 |
| 3,881,376 | 5/1975 | Stumpf | 83/56 |
| 4,419,913 | 12/1983 | Schütt et al. | 83/937 |

FOREIGN PATENT DOCUMENTS 3530886 11/1986 Fed. Rep. of Germany .

*Primary Examiner*—Frank T. Yost
*Assistant Examiner*—Hwei-Siu Payer
*Attorney, Agent, or Firm*—Ostrolenk, Faber, Gerb & Soffen

[57] ABSTRACT

A method for cutting blanks from webs of material, including some extra-long blanks which are longer than the cutting table. The extra-long blanks are only partially cut out in a first cutting step. Then, after further advance of the web onto the cutting table, the extra-long blanks are separated completely from the web.

21 Claims, 9 Drawing Sheets

METHOD OF CUTTING BLANKS FROM WEBS OF MATERIAL

CROSS-REFERENCE TO RELATED APPLICATION

This is a continuation-in-part of U.S. application Ser. No. 07/374,460 filed Nov. 21, 1988, now U.S. Pat. No. 4,972,745, issued Nov. 27, 1990.

BACKGROUND OF THE INVENTION

1. Field of the Invention

The present invention relates to a method and apparatus for cutting blanks from webs of material which are moved across a cutting region and cut by cutting means. More particularly, the method and apparatus permit the cutting out of patterns that cannot be fully accommodated within the cutting region during any single cutting step.

2. Background Art

In the past, in order to cut materials, for instance textiles, layers (sheets) of material had to be provided having at least the same length as the corresponding pattern to be cut out. In the clothing industry one works predominantly with a layer length (or cutting pattern length) of 4 to 7 meters, from which different patterns are then cut. In the upholstered furniture industry, layer lengths up to 15 meters are customary. The material layers, for example fabric layers, are laid out on pallets outside the cutting table by hand or by means of a laying machine. Then one individual pallet is placed on the cutting table and the cutting is effected by hand-guided cutting knives or an automatic cutting device (for instance a water-jet or laser-beam cutting device).

With this method the maximum possible cutting-pattern length is limited by the length of the cutting table.

For longer lengths it is known to provide a continuous brush-like conveyor belt on the cutting table which can transport a correspondingly longer pallet over the cutting table or through the actual cutting region.

It is quite common also to place several layers one on top of the other and cut them in one operation.

With both methods the fact must be borne in mind that the specific layer lengths must be longer, by a certain margin of safety (customarily 3 to 5 cm), than the length of the contours to be cut out. This is important in order to obtain a clean cutting line at the end of each individual contour, and furthermore to be able to take into account possible tolerances in connection with the placement of the individual layers on the pallets or the adjustment of the cutting tool.

Both methods have the disadvantage that long cycle times result from the placement of the layers on the pallets outside the cutting region. Also, the required margins of safety in each layer result, in general, in a large amount of waste. This not only increases the cost of manufacture but also, depending on the nature of the material used, results in some degree of pollution of the environment when the waste is disposed of.

Federal Republic of Germany AS 2,301,736, related to U.S. Pat. Nos. 3,769,488 and 3,761,675, discloses an apparatus for cutting flat material with which a more streamlined manner of operation is possible. However, the method of cutting to be carried out with this apparatus has the disadvantage that the web of material is pushed forward by constant, identical distances regardless of the contour of the blank which is to be cut out.

As a result, the machine has a long cycle time and a very great length.

Federal Republic of Germany OS 3,530,886 discloses a method for the automatic cutting of materials from a web of material. For this purpose there is used a cutting table having a brushlike cutting-material resting surface which is developed as an endless conveyor belt. The web of material, which can be withdrawn from a roll, is held on the cutting-material resting surface by a vacuum and cut. After a given length of cut has been effected, the cutting-material resting surface is transported further until the blanks which have been cut out can be removed.

This method can only be employed if the contour to be cut out is not larger than the distance from the place of cutting to the end of the cutting table. Furthermore, because the material is held by a vacuum, only a single-layer cut can be effected, which results not only in long cycle times but also in long setup times.

All prior art materials mentioned in this patent disclosure are expressly incorporated by reference.

SUMMARY OF THE INVENTION

In view of the foregoing, an important object of the present invention is to provide a method for cutting blanks from webs of material which requires only a short cycle time and which furthermore makes it possible to dispense with substantial safety margins in connection with the individual layers.

A further object is to provide a method which makes it possible to cut even complicated contours which are of greater length than the cutting surface available.

Thus, a method of cutting blanks from a web of material, according to one feature of the invention, comprises the steps of:

defining a cutting pattern which defines a plurality of contours along which the web will be cut in order to cut out the blanks;

the cutting pattern being defined so that at least a first one of the blanks extends from a first web segment into an adjacent second web segment;

moving the web to place a series of predetermined segments of the web successively over a cutting table, and using a cutting device associated with the cutting table to cut the contours that are within the segment of the web then over the cutting table;

wherein the moving step includes the steps of:

placing the first web segment on the cutting table and cutting out the portion of the contour of the first blank within the first segment in a first cutting step;

moving the web so that the second web segment, including the already cut-out portion of the first blank, are placed on the cutting table; and in a second cutting step, cutting out the portion of the contour of the first blank that is within the second web segment.

An additional object is to permit cutting of the contours in multiple layers, and to permit the desired layer thickness to be increased rapidly and in a simple manner by inserting additional rolls of cutting material.

Thus, according to another feature of the invention, the layers of material are provided by respective material rolls mounted in a laying station on carriages which are slidable lengthwise on the apparatus. When a given roll is empty it can be removed laterally by a removal device and the remaining rolls can be slid lengthwise to close the gap. Then a new roll is inserted at a loading place at one end of the laying station, and the uppermost layer of material to be cut is provided by this new roll. Thus, the replacement of empty material rolls is easily effected, since the rolls are always inserted at the same place. The result is that a new web of material is always present at the uppermost position, regardless of how many layers are cut. In addition to the simplicity in handling, this also results in short setup times.

BRIEF DESCRIPTION OF THE DRAWINGS

Other objects, features and advantages will be understood from the following detailed description of embodiments thereof, with reference to the drawings, in which.

DETAILED DESCRIPTION OF THE EMBODIMENTS

Figure 1:
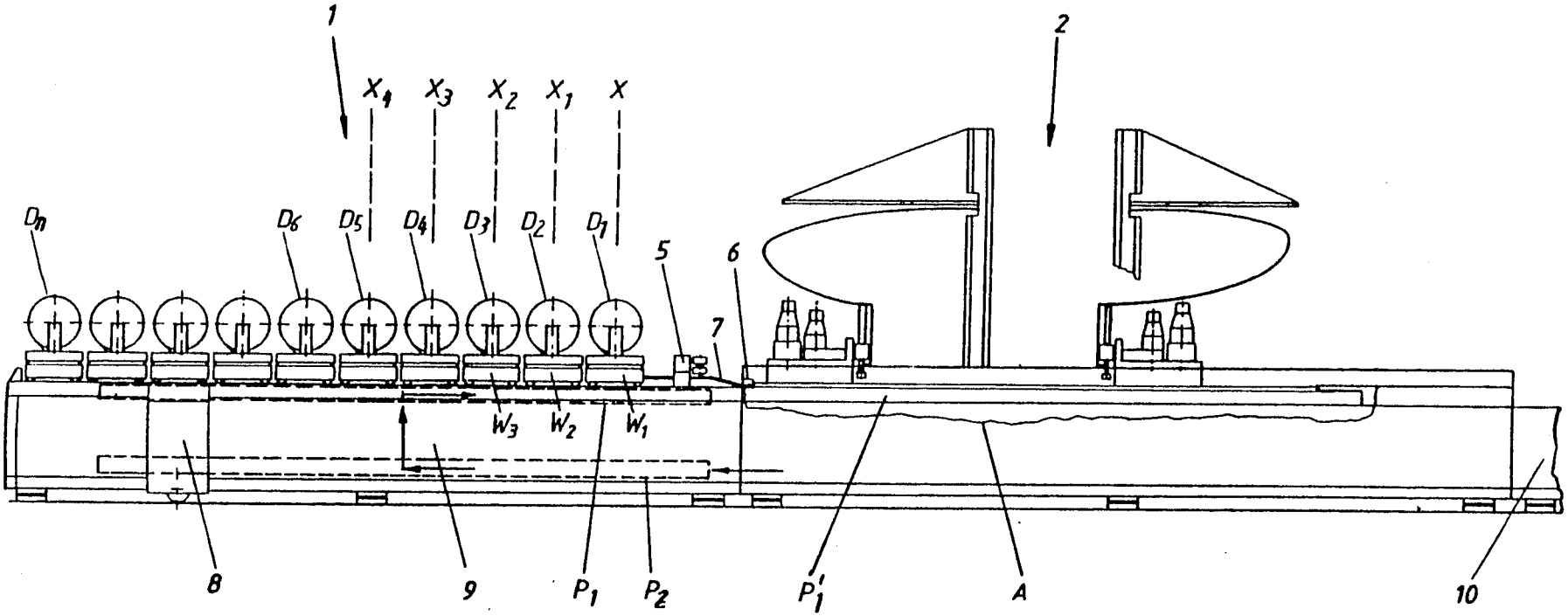
FIG. 1 is a side view of a complete cutting apparatus.

FIG. 1 shows a complete cutting apparatus, which comprises a cutting unit 2, a laying station 9 arranged in front of it (upstream), and a removal station 10 arranged behind it (downstream).

The laying station 9 includes a roll changer 1, several pallets P and a fixed clamping beam 5, as well as one or more carriages $W_1$, . . . , $W_n$ which are mounted for longitudinal displacement on rails 3 and 4 above the pallets P and on which a corresponding number of material rolls $D_1$, . . . , $D_n$ can be turnably mounted.

The removal station 10 is where the blanks which have been cut out are removed from the cutting apparatus.

The gantry 11 of the cutting unit 2 is provided with an end-position switch (described below) which is actuated when a pallet P has been brought into the cutting region A and reaches said switch.

Before the cutting starts, rolls of material D are loaded onto the carriages W in a number corresponding to the desired layer thickness of the web of material 7. Then, the material rolls D are turnably mounted on the carriages W. Also at the beginning of the layout process, pallet $P_1$ is shifted to the right (as seen in FIG. 1), out of the position shown in FIG. 1, until its forward end is below the clamping beam 6. Then the rolls and carriages W are loaded on the roll changer 1 by means of the loading and unloading carriage 8 (FIG. 2), and the material on each of the rolls D is threaded below the clamping beams 5, 6.

In the process of loading and threading the material to be cut, first the roll $D_n$ on the carriage $W_n$ is loaded at the position X. The carriage $W_n$ is then pushed to the left (as seen in FIG. 1) so that it assumes the position $X_1$, which was unoccupied up to that time, and the loading position X is again free. The loading process described above is repeated with the second roll $D_{n-1}$ and carriage $W_{n-1}$, and after the second web of material has also passed below the clamping beams 5, 6, the carriage $W_{n-1}$ is again pushed to the left (in the drawing), so the loading position X is again free and the positions $X_1$ and $X_2$ are now occupied, by carriages $W_{n-1}$ and $W_n$, respectively.

This process is repeated until the clamping beams 5, 6 have beneath them a number of individual webs of material piled one above the other which correspond to the desired layer thickness of the web material 7. Then the clamping beam 6 is lowered, whereby the web of material 7 is clamped to the downstream end of the pallet $P_1$.

The length of each pallet corresponds to at least the length of the cutting region A. Together with the clamping beam 6 mounted thereon (see FIG. 5), the pallet $P_1$ is transported into the cutting region A, in which connection the web of material 7 is unwound from the rolls D corresponding to the distance the pallet $P_1$ has been moved over. The pallet $P_1$ moves to the location in the cutting region A indicated by $P_1'$ in FIG. 1.

Figure 4:
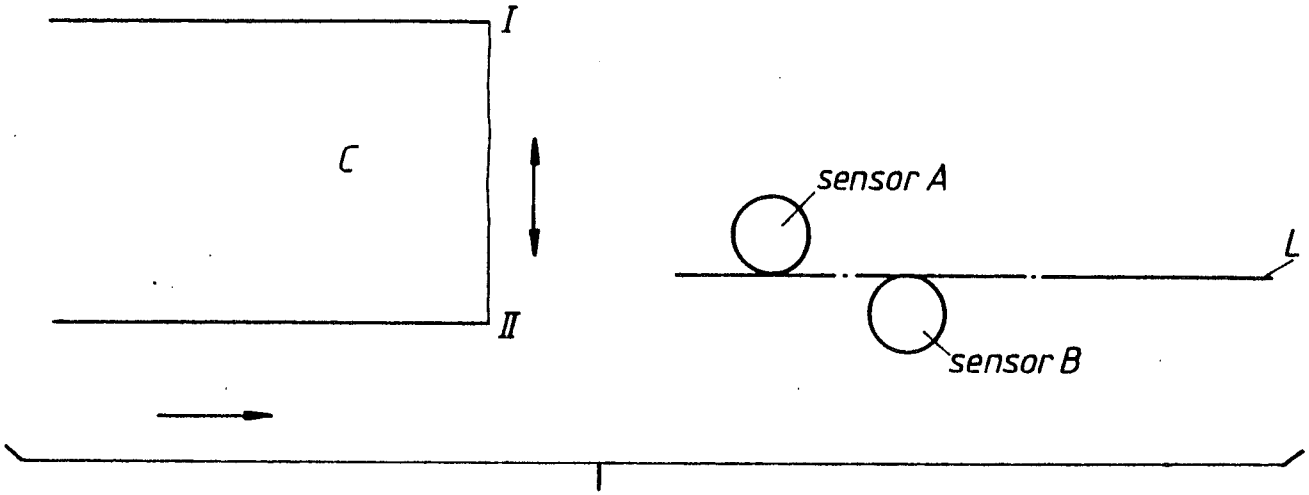
FIG. 4 PRIOR ART
FIG. 4 is a schematic diagram for explaining a known system for sensing and controlling the longitudinal edges of a roll of material.

As the material webs unwind from the rolls D, their longitudinal edges are sensed and controlled by a known edge control system, illustrated schematically in FIG. 4. When material is wound into a roll, its edges may not precisely coincide from layer to layer, because the material can migrate to the left or right while it is being rolled up. The known method of positioning the edges, which involves sensing one edge, compensates for this rolling error by shifting each carriage $W_1$, . . . , $W_n$ to the left or right to ensure that the edge of the material will always coincide with a predetermined straight line.

In FIG. 4, web C is intended to be positioned precisely along line L. Sensor B can detect when web C extends too far in direction II, and the carriage on which the roll of material is mounted on is returned to a corresponding extent in direction I. In the opposite situation, sensor A detects a deviation from line L toward direction I, and the associated carriage W moves in direction II. Each carriage $W_1$, . . . , $W_n$ advantageously has its own edge controls. This known edge control system orients the edges of the respective webs in the disclosed embodiment at the correct position.

Figure 2:
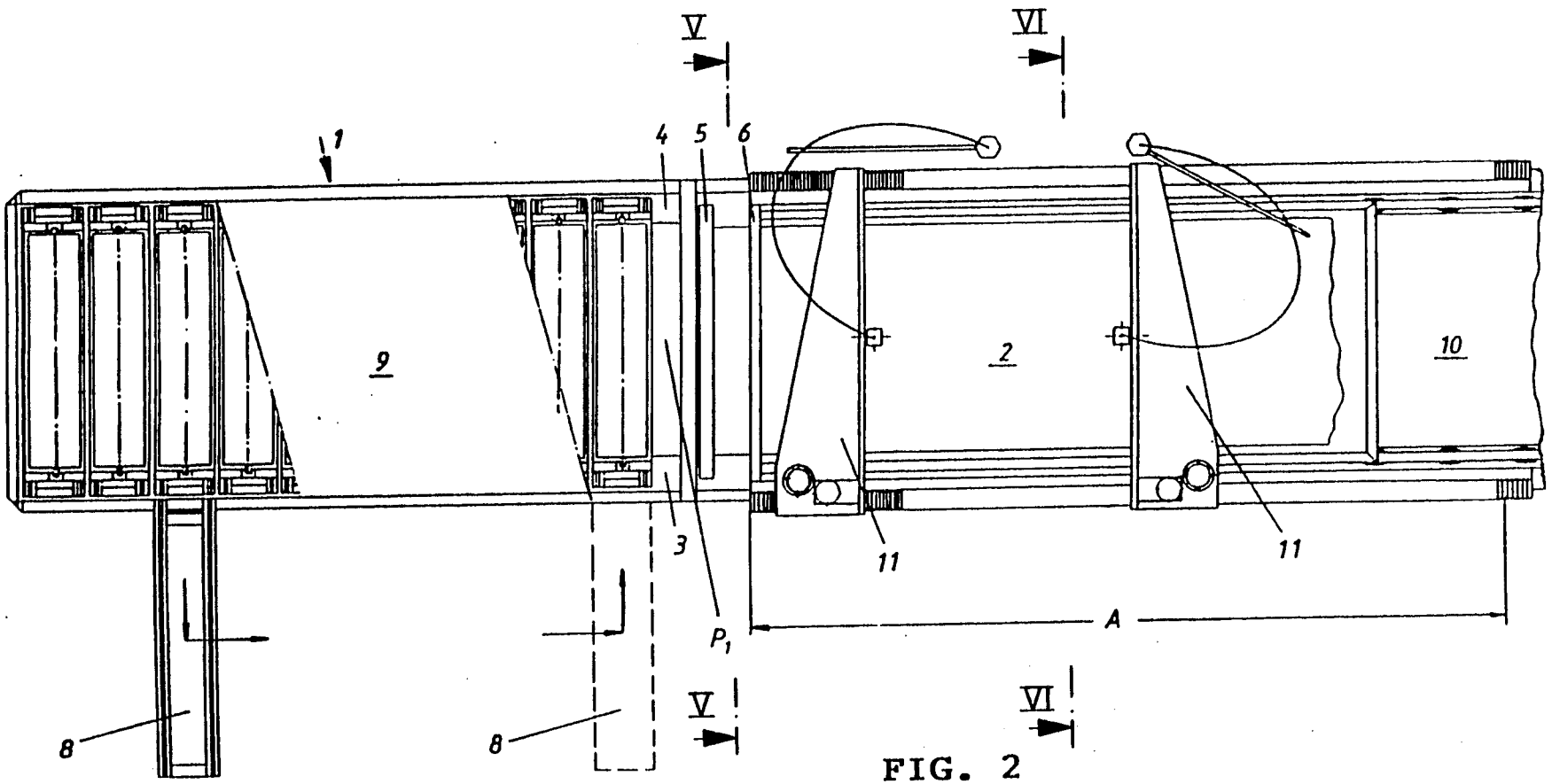
FIG. 2 is a plan view of the cutting apparatus of FIG. 1.
Figure 5:
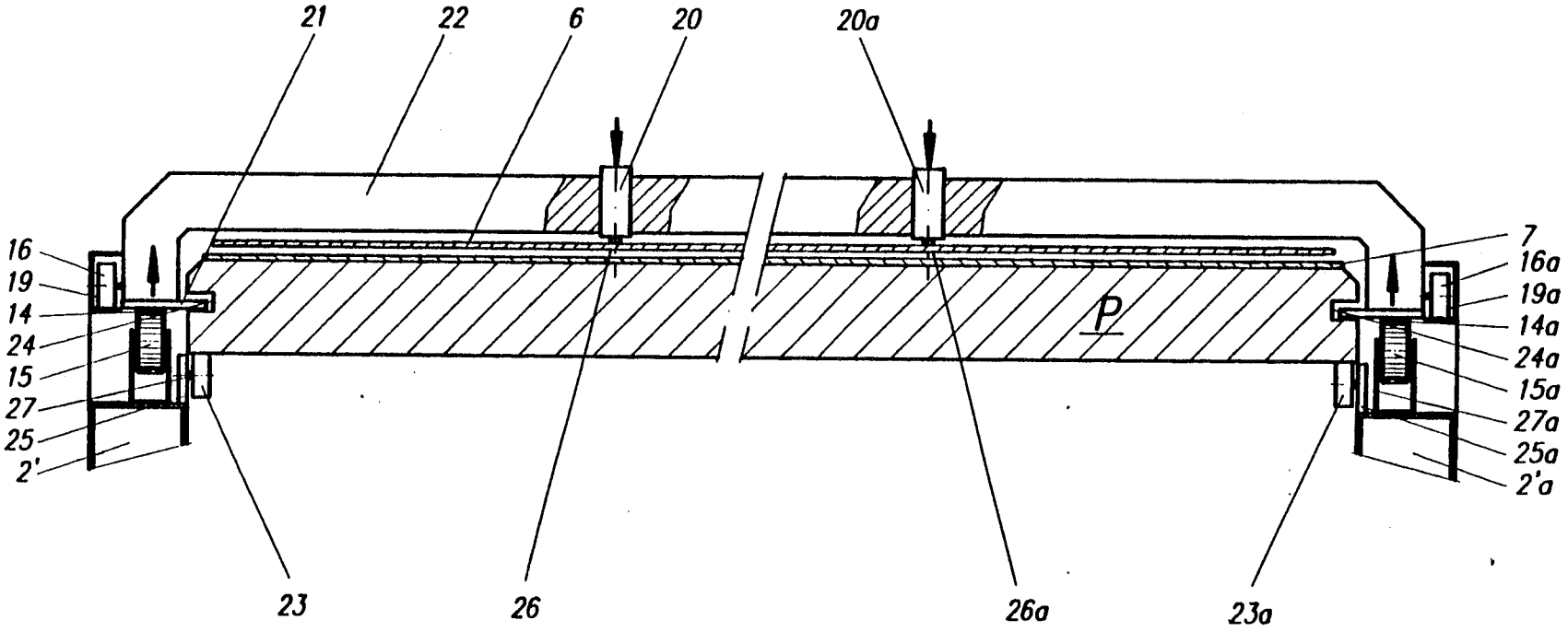
FIG. 5 is a cross-sectional view taken transversely to the pallet P along line V—V in FIG. 2, showing the clamping beam 6 and related elements.
Figure 5A:
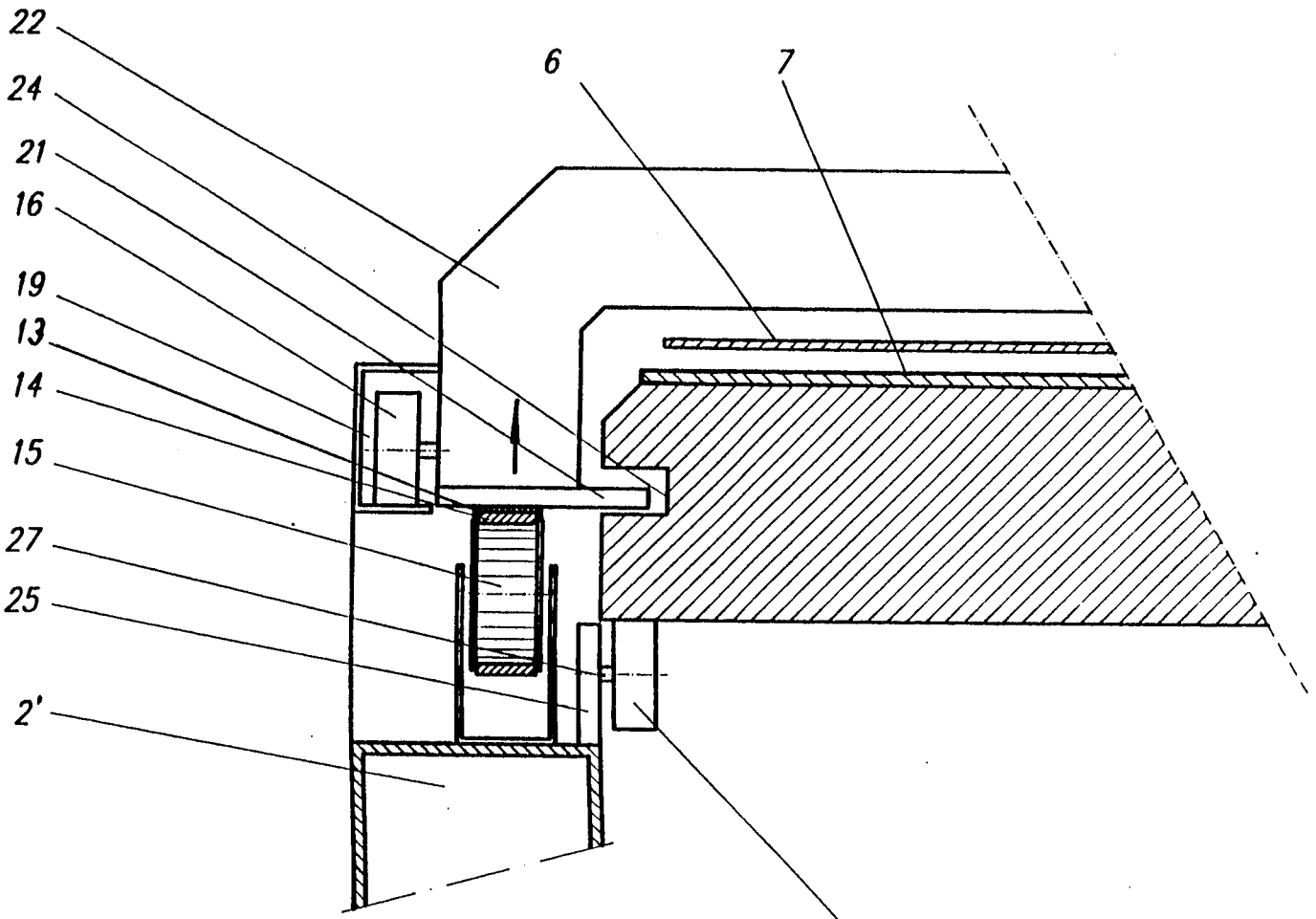
FIG. 5*a* is an enlarged view of part of FIG. 5.

An example of an arrangement for the clamping beam 6 is shown in detail in FIGS. 5 and 5*a*. FIG. 5 is a detailed cross-section taken along line V—V in FIG. 2 FIG. 5*a* is an enlargement of part of FIG. 5.

The clamping beam 6 is fixed to the piston rods 26, 26*a* of two pneumatic cylinders 20, 20*a*. These cylinders are attached to a U-shaped bent clamp 22. The clamp 22 extends over the full width of the cutting unit 2. The clamp 22 is provided with holding devices 21, 21*a* on both sides which cooperate with grooves 24, 24*a* that are positioned on either side of the pallet P. The holding devices 21, 21*a* have toothing 13 on the bottom side. The clamping beam 6 is movable in longitudinal direction by means of two toothed belts 14, 14*a* which are driven via toothed wheels 15, 15*a* that are fixed on the frame of the cutting unit 2 and that cooperate with the toothing 13 of the clamp 22.

Two guide rollers 16, 16*a* are laterally fitted to the clamp 22 which are guided in tracks 19, 19*a* that are incorporated in the cutting table 2 to ensure trouble-free straight running of the clamp 22.

In order to fix the web of material 7 onto the pallet P, the pneumatic cylinders 20, 20*a* are actuated and consequently the piston rods 26, 26*a* are extended and the clamping beam 6 is lowered onto the web of material 7. While the clamping beam 6 is held by the cylinders 20, 20*a* on the web of material 7 on the pallet P, the clamp 22 is lifted in the opposite direction (see the arrows in FIG. 5) and the holding devices 21, 21*a* grip into the grooves 24, 24*a*. By increasing the force of the cylinder 20, 20*a*, the web of material 7 is fixed to the pallet P. Also, the teeth 13 and 14 are separated and thereby the connection between clamp 22 and toothed belt 14, 14*a* is interrupted. Pallet P, which is guided by rollers 23, 23*a*, can then carry the clamp 22 and the clamping beam 6 into the cutting area A.

When the pallet P has reached its end position, the pneumatic cylinders 20, 20*a* are relieved, whereby the clamp 22 falls back onto the guide rollers 16, 16*a* in the tracks 19, 19*a* due to its own weight.

Simultaneously, the drive of the toothed belt 14, 14*a* and the drive wheels 15, 15*a* again cooperate, and the clamping beam 6 travels back to the beginning of the cutting area A, i.e., it goes back to its starting position.

The rollers 23, 23*a* are assembled by means of an axle 27, 27*a* onto a holder means 25, 25*a*. This holder means 25, 25*a* is fixed on the frame 2', 2'[a of the cutting unit 2. Several of the rollers 23, 23*a* are mounted along the longitudinal direction (X-direction) on the frame 2'.

By these means, the clamping beam may be secured to the pallet and will be shifted along with it as the pallet moves.

When the pallet $P_1$ has moved to the right (as seen in FIGS. 1–2) and reached its end position $P_1'$, the clamping beam 6 is loosened and moved back into its starting position. In this embodiment, the clamping beam 6 is provided with its own drive mechanism, described above, whereby the return motion is automatic The cutting process can then commence.

Figure 3A:
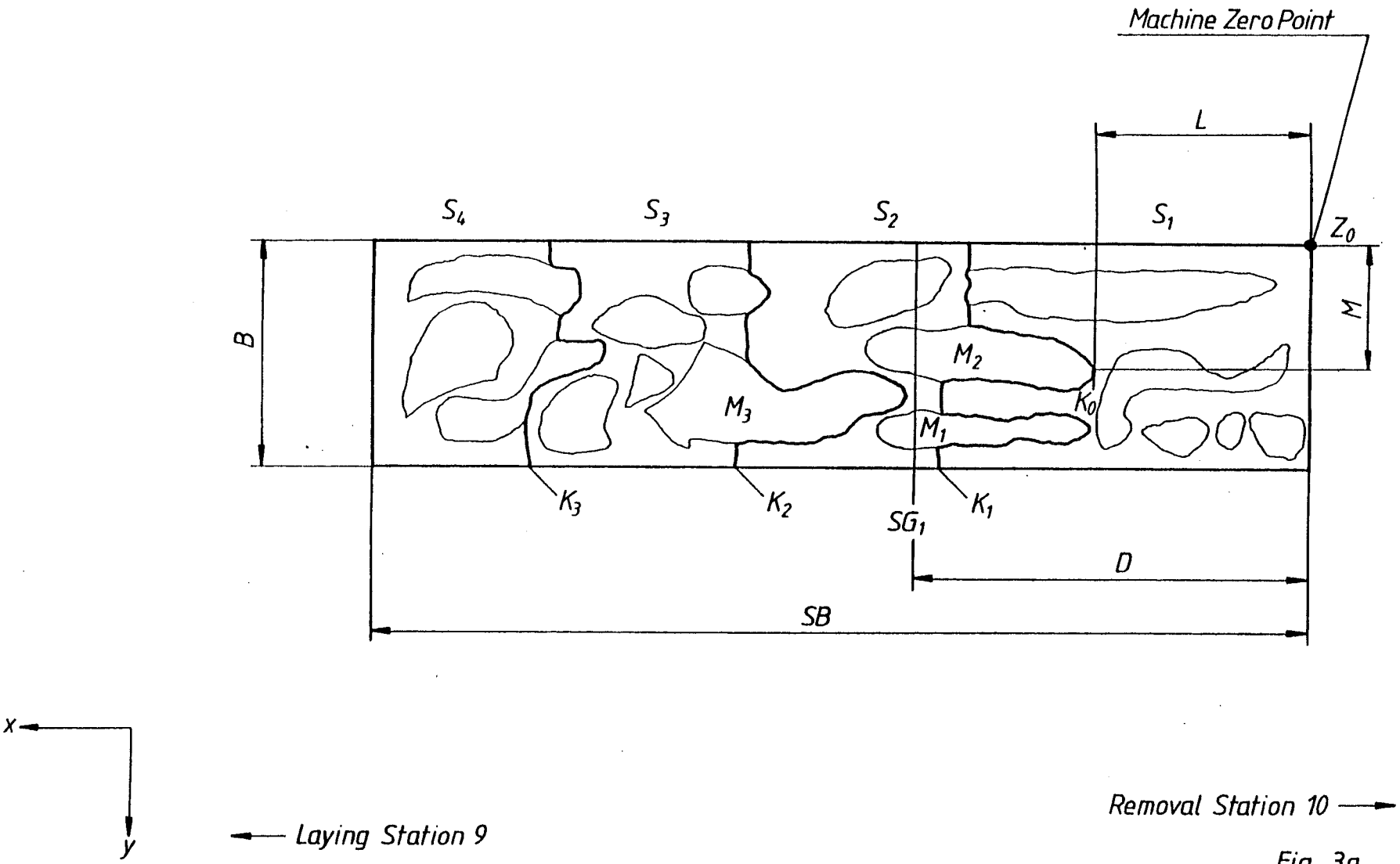
FIGS. 3*a*, 3*b*, and 3*c* are plan views showing a pattern to be cut out of a web, the pattern comprising several blanks to be cut out of the web by cutting respective arbitrarily shaped contours, wherein the pattern is divided into segments ($S_1$, $S_2$, $S_3$, . . .) whose size is determined approximately by the size of the cutting region, and wherein some of the individual contours to be cut out ($M_1$, $M_2$, $M_3$, . . .) project from one segment into the general area of the next segment.
Figure 3B:
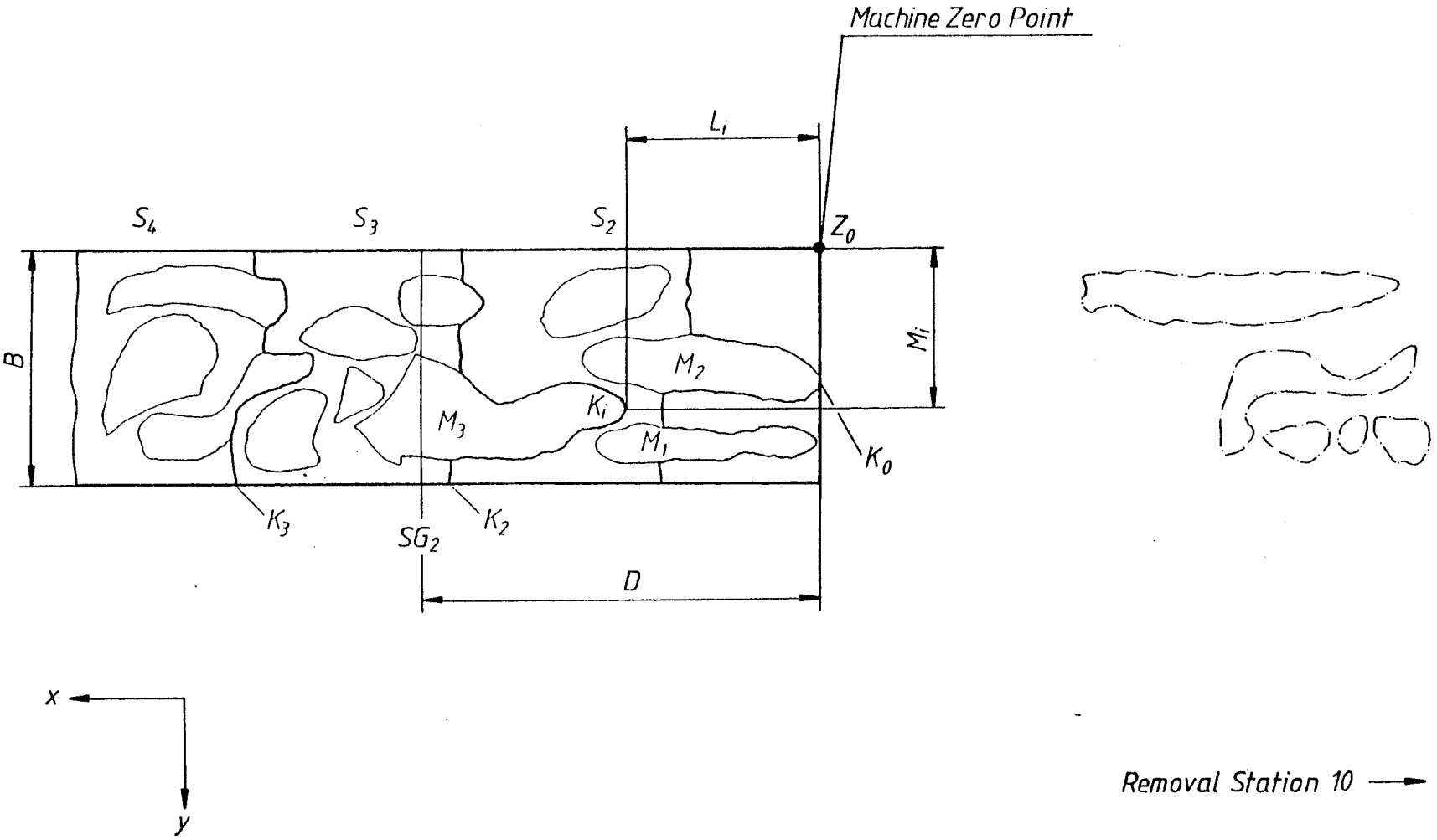
Figure 3C:
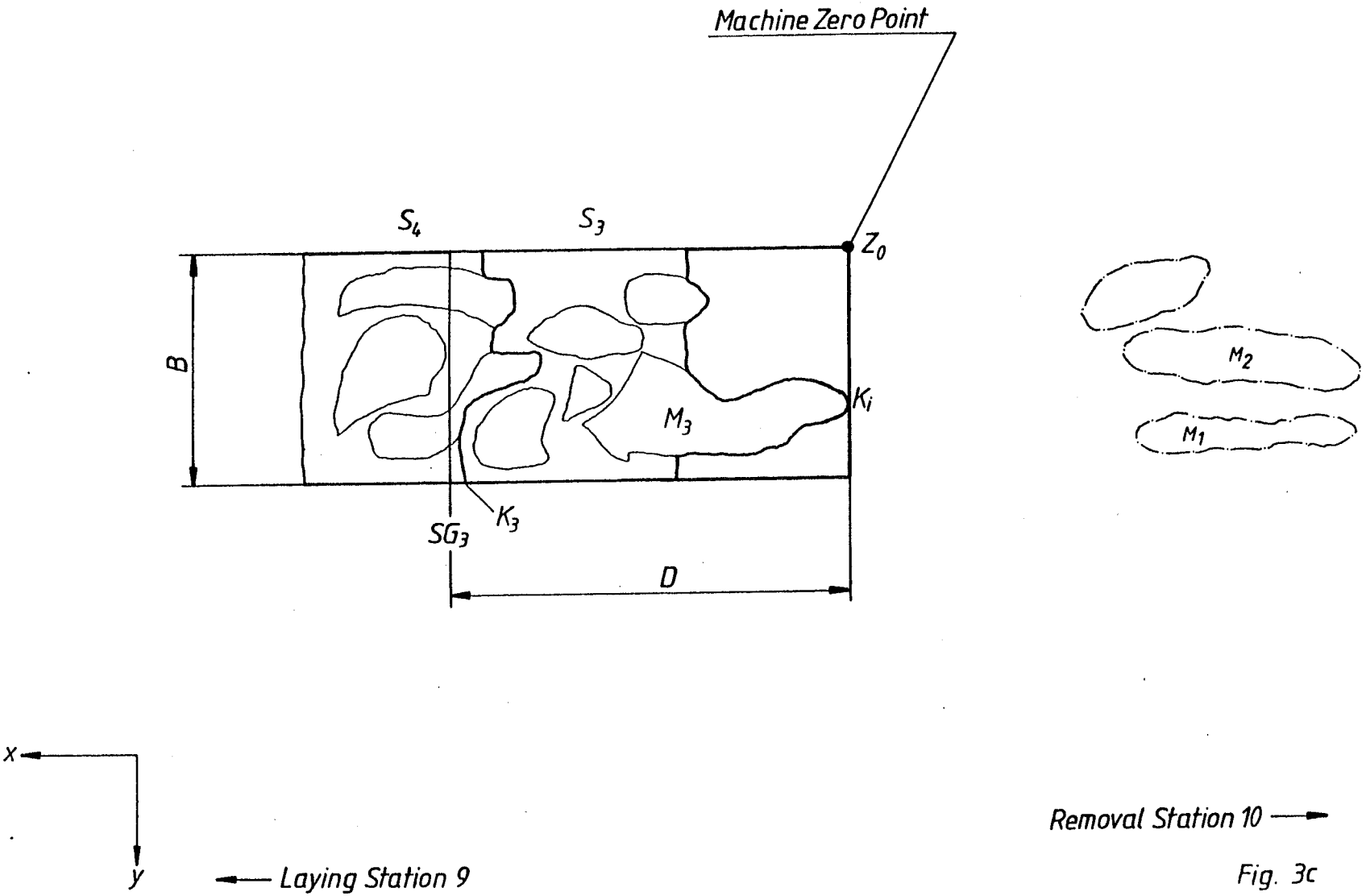

As shown in FIG. 3*a*, the complete cutting pattern SB is divided into individual segments S, wherein the lengths of the individual segments S correspond approximately to the length of the cutting region A. As seen in FIGS. 3*a*–3*c*, the direction of movement of the pallets and the webs is from left to right.

The individual contours to be cut out are so distributed within the overall cutting pattern SB, with due consideration of the corresponding width B of the material, that only minimal waste remains Possible methods for this purpose are known from Federal Republic of Germany OS 3,627,110.

By the use of the method described herein, it is immaterial whether the contours to be cut extend beyond the segment boundaries SG or not and correspondingly, whether they are located fully inside or still completely outside the cutting region A when a given pallet is in position for cutting.

The cutting of the contours within segment $S_1$ (five complete contours and two partial contours in this example) is started in the direction away from the removal station 10 and toward the laying station 9. A double-gantry system can be used as shown, or a monocutting system can also be used The web can be controlled for carrying out the cutting by means of an ordinary draw-in control, the individual contour data being stored in the main memory of the control mechanism (Federal Republic of Germany OS 3,627,110, equivalent to U.S. Pat. No. 4,941,183, and Federal Republic of Germany AS 2,301,736, related to U.S. Pat. Nos. 3,769,488 and 3,761,675, show how this can be done).

When the cutting gantry 11 has reached the end of the cutting region A, a cut $K_1$ is made over the entire width B of the web of material 7 so that the web is separated from the rolls. This cut $K_1$ is generally not effected linearly but—as shown in FIG. 3*a*—follows the contours (within the segment being cut) defining those blanks which lie partially within the cutting region A but also extend beyond the corresponding boundary of the segment S being cut at the time. For example, the cut $K_1$ follows the partial contours within segment $S_1$ of the blanks $M_1$ and $M_2$ (which blanks extend out of segment $S_1$ and into segment $S_2$, and correspondingly are not fully within the cutting region A).

It is not absolutely necessary to effect the cut $K_1$ at or near the end of the cutting region; rather, as shown by cut $K_2$ in the case of segment $S_2$ in FIG. 3*c*, the cut can also be effected in the middle of the cutting region A, provided that no subsequent cut over the entire width B should be required by the optimized pattern layout.

For this purpose a suitable control program is provided, the development of which is within the skill of the ordinary software designer.

Accordingly, patterns M1, M2, which extend over two adjacent segments $S_1$ and $S_2$, are initially only partially cut out. After this, the NC-controlled cutting gantry 11 moves back upstream to the x-coordinate L which corresponds to the point $K_0$, which is the point at which the partially cut-out patterns $M_1$ $M_2$ extend farthest into the cutting region A toward the removal station 10. This is done, as will be explained further below, so that the pallet $P_2$ can be brought downstream under the partially cut contours $M_1$ and $M_2$.

The stationary clamping beam 5 is lowered onto the web of material 7 which is still attached to the rolls D, so that the web of material is held fast on the laying station 9. The following pallet $P_2$ is transported so far forward that it almost strikes against the pallet $P_1$ which is present at position $P_1'$ in the cutting region A. By fixing the web of material 7 in place by means of the clamping beam 5, it is assured that more material will not be withdrawn from the rolls D and that folds will not form by the movement of pallet $P_2$. Then both pallets $P_1$ and $P_2$ are moved at the same speed to the right until the pallet $P_2$ passes the end switch (described below) on the cutting gantry 11 (which is still at the location L which corresponds to the point $K_0$, where the partially cut-out contours extend farthest into segment $S_1$ toward the removal station 10) and further transport is interrupted. Thus, the pallets are moved only far enough to continue the cutting of the partially cut-out pieces $M_1$ and $M_2$ whereby they will then be completely cut. At this point, all the partially cut-out contours (such as $M_1$ and $M_2$) have come to lie completely on the pallet $P_2$.

The clamping beam 6 is then lowered and the stationary clamping beam 5 is loosened, whereby the web of material 7 is fixed to the pallet $P_2$. Both pallets $P_1$ and $P_2$ are transported further until pallet $P_1$ arrives completely at the removal station 10 and pallet $P_2$ has arrived fully in the cutting region A (FIG. 3*b*). The cutting gantry 11 is shifted to the right by the same amount to allow cutting to continue, as will be described below. The x-coordinate of point $D_0$ shifts simultaneously (see FIG. 3*b*), but not the y-coordinate. Then the clamping beam 6 is loosened and returns to its starting point As mentioned above, the clamping beam 6 is provided with its own drive, which operates in synchronism with the feed device.

The cutting gantry 11 thereby travels to the place farthest downstream where the pattern is already partially cut and can carry out further cutting by again proceeding from the direction of the removal station 10 toward the laying station 9. At the end of such further cutting, another cut $K_2$ is made over the complete width B of the web of material 7, within segment $S_2$, and the process previously described is started again.

During the cutting program, the blanks which have been cut out can be removed at the removal station 10.

The machine zero point $Z_0$ shown in FIGS. 3*a*–3*c* is an arbitrary point associated with the cutting region A. It is stored in the electronic controls, and all parameters (curve coordinates, motion of the cutting tool, etc.) of the cutting method and apparatus are derived from it In the embodiment of FIGS. 3*a*–3*c*, the machine zero point is at a corner of the cutting region A toward the removal station 10.

In FIG. 3*a*, the point $K_0$ is precisely prescribed to be spaced a distance L behind the machine zero poi $Z_0$. Point $K_0$ represents the furthest penetration of the cutting tool toward the removal station 10, into the cutting area A, when the curve $K_1$ is cut. The coordinates of the point $K_0$ are (L, M) in the example of FIG. 3*a*.

Once it has been defined, an appropriate software program is able to convert the coordinates (x, y) of the position $K_0$ into new coordinates (x', y), and the cutting gantry 11 or, better, the cutting nozzle is initially shifted to that point in order to leave enough space in cutting area A to bring another pallet $P_2$ up to the end of pallet $P_1$, and then both pallets and the cutting gantry 11 are shifted together toward removal station 10 at the same speed.

The disclosed embodiment of the method will now be described in greater detail.

First, the complete cutting pattern (SB) is defined (FIG. 3*a*). The shapes of the contours M1, M2, M3, etc. are predetermined and how many are to be cut out. The contours are stored in the computer in digitized form and are displayed on the monitor The operator moves the displayed contours interactively on the monitor, for example with a joystick, and in that way carries out the process of nesting and distributing the contours so that only minimal waste remains When the complete pattern has been produced it is stored in the computer The length D (FIGS. 3*a*–3*c*) of the cutting region A is also stored.

The operator then calls the first segment boundary $SG_1$, as shown in FIG. 3*a*. Part of the pattern and the segment boundary can be seen on the monitor, i.e. from the beginning of the pattern at the machine zero point $Z_0$ up to the maximum traveled distance of the cutting gantry which corresponds to the length D of the cutting region A. The operator decides how the first contour cut $K_1$ is to be arranged and gives the data to the computer in an interactive manner, as shown in FIG. 3*a*, segment $S_1$. The contour cut $K_1$ is preferably positioned in such a way that it runs along the contours to be cut to the greatest extent possible.

After the complete contour cut $K_l$ has been defined and stored, the computer ascertains the farthest point the contour cut $K_l$ will extend into the cutting region, thereby defining point $K_0$. Then the operator can have the second segment boundary $SG_2$ displayed on the monitor, as shown in FIG. 3*b*. This is automatically ascertained by the computer, as will be explained in greater detail later The segment $S_2$ extends from point $K_0$, further into the pattern (toward the left in the drawings), by the length D of the cutting region A. The operator then determines the next contour cut $K_2$ which is then stored, and the computer determines the point $K_i$ extending farthest into the cutting region.

In this way, the individual segment boundaries SG are successively displayed on the monitor and the contour cuts to be performed are determined.

When these data have been stored and are fully available they are used to control the cutting machine.

After material web 7 together with pallet 1 have completely moved into the cutting region, segment $S_1$ will be automatically cut and for that purpose the stored contour data of the pattern SB as well as the stored data of the contour cut $K_l$ are used. As soon as the contour cut $K_l$ has been completed the cutting gantry moves back downstream to point $K_0$, i.e., it takes the position exactly at the end of the partially cut pattern $M_2$ that extends the farthest into the cutting region A. The clamping beam 5 is lowered so that the material web is held at the laying station 9. A further pallet $P_2$ then is moved forward until it almost touches the end of pallet $P_1$ which is in the cutting region A. The cutting gantry 11 is equipped with an end switch (described below) which cooperates with each pallet for indicating engagement of the gantry with the pallet. This end switch can be hinged down from the cutting gantry 11. In the folded-up position it is outside the movement area of the movable clamping beam 6.

Then both pallets $P_1$ and $P_2$ are moved with the same speed toward the removal station 10. Since the stationary clamping beam 5 has been lowered, the material web 7 is held in position and therefore cannot be displaced The pallets $P_1$, $P_2$ are transported only until the pallet $P_2$ reaches the end switch which is located at the cutting gantry. The end switch is then folded up and the clamping beam 6 is brought to the front (upstream) end of pallet $P_2$ and lowered thereon Thus, the material web is fixed on pallet $P_2$. Then, the clamping beam 5 is loosened and the pallets $P_1$, $P_2$ are restarted and move so far that pallet $P_1$ gets completely into the removal area 10, where all the completely cut patterns can be taken away, and pallet $P_2$ is now completely in cutting region A. During transport the webs of material 7 are unwound from the material rolls $D_i$. Now the existing point $K_0$ corresponds to the line of the machine zero point (see FIG. 3*b*).

The next segment boundary SG2 will then be defined, i.e., the length of the pattern up to the point $K_0$ is deducted so a new origin point (x',y) is now defined, with x' being the previously defined x-coordinate of the point $K_0$. The length D of the cutting region A is added to the coordinate x', and as before, the operator defines the relevant contour cut $K_2$ for cutting the second segment $S_2$.

The cutting process continues as described before with respect to segment $S_1$ The individual segments S are cut one by one until the pattern has been completely cut out (see FIG. 3*c*).

Figure 6:
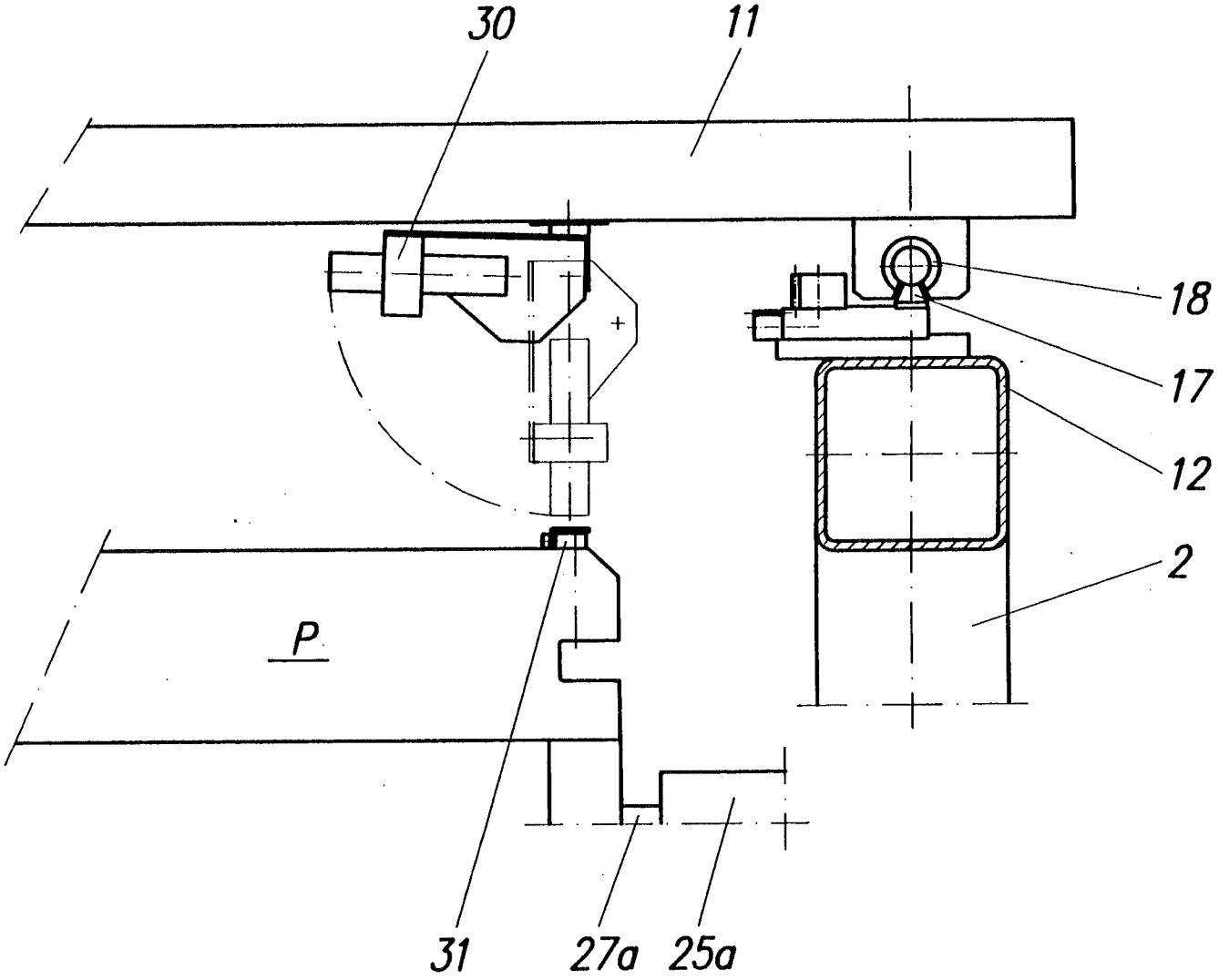
FIG. 6 is a partial cross-sectional view taken along line VI—VI in FIG. 2, showing aspects of the end switch 30 on the cutting gantry 11.

FIG. 6 is a cross-sectional view taken along line VI—VI in FIG. 2, showing the end switch 30, which is fitted to the cutting gantry 11, and can be swivelled as shown Messrs IFM Electronic GmbH is the supplier of this well-known inductive acting end switch which is sold under the tradename "Initiator IAE 3010." A sensor 31 is located at the front end of the pallet P (i.e., the end toward the removal station 10) that works in conjunction with the end switch 30. This sensor 31 is an angular metal plate which is screwed onto the pallet P. As long as the cutting gantry is activated, the end switch 30 is up, i.e., it has a parallel position to the cutting gantry 11. The cutting gantry 11 is guided via linear guide elements 17, 18 which are positioned on the frame 12 of the cutting unit 2.

At the end of the cutting step, the end switch 30 is hinged down, i.e., it is moved into vertical position with respect to the cutting gantry 11 which has carried out the contour cut K This can be done pneumatically, electrically or even by hand. However, to perform the cutting process in fully automatic mode it is usually driven pneumatically or electrically.

The inductive end switch 30 is connected to the electronic control device of the cutting unit 2. When pallet P has travelled far enough into the cutting area A, the sensor 31 which is positioned on pallet P reaches end switch 30. This produces an output signal which in turn instructs the control unit to stop the drive of the pallet P The end switch 30 can then again be swivelled upward and the transport of the pallets $P_1$, $P_2$ can be conducted as described before.

According to another feature of the invention, it is also possible to effect the transport of at least four pallets P from the removal station 10 to the laying station 9 below the cutting apparatus in a continuous rotation, which further reduces the cycle time of the process.

Although the invention has been described with respect to specific embodiments thereof, the appended claims are not so limited, but are to be construed as embodying all modifications and variations that may occur to one of ordinary skill in the art and that fairly fall within the teachings of the present disclosure.

What is claimed is:

1. A method for cutting blanks from a web of material, comprising the steps of:

a) defining a cutting pattern which includes a plurality of contours along which the web will be cut in order to cut out said blanks;

b) defining a first segment of said cutting pattern, said first segment being defined so that at least a first one of said blanks extends from the first segment into an adjacent second segment;

c) supporting said first segment on a first pallet; and locating said first pallet so as to place said first segment in a cutting area;

d) in a first cutting step, using a cutting device associated with the cutting area to cut the contours that are within the first segment, including the partial contour of said first blank which is within said first segment;

e) defining a second segment of said cutting pattern, which includes an uncut partial contour of said first blank;

f) moving a second pallet so that it supports both said second segment and said cut partial contour of said first blank within said first segment;

g) moving said first pallet in a downstream direction so as to permit said cut partial contour of said first blank to be transferred to said second pallet, and so as to carry any completely cut blanks of said first segment away from said first blank;

h) moving said second pallet into said cutting area; and i) in a second cutting step, cutting out the uncut portion of the contour of said first blank which is within said second segment.

2. A method as in claim 1, wherein said first blank is only partially cut out in said first cutting step when the first segment is in the cutting area, and the cutting thereof is completed in the second cutting step, after the advance of the second segment into the cutting area.

3. A method as in claim 2, wherein a second blank is defined completely within said second segment and is completely cut out in said second cutting step.

4. A method as in claim 1, wherein said step of defining the cutting pattern includes distributing the blanks to be cut out on said web without substantial waste of said material.

5. A method as in claim 1, wherein said step of defining said cutting pattern includes extending the first blank at least into a third one of said segments, adjacent to said second segment, so that the cutting thereof is not yet completed in the second cutting step, after the advance of the second segment into the cutting area.

6. A method as in claim 5, wherein a second blank is defined completely within said second segment and is completely cut out in said second cutting step.

7. A method as in claim 6, wherein a third blank is defined completely within said third segment and is completely cut out in a third cutting step.

8. A method as in claim 5, wherein a third blank is defined completely within said third segment and is completely cut out in a third cutting step.

9. A method as in claim 1, wherein said first cutting step includes forming a first cross cut transversely to said downstream direction, from one side to the opposite side of said web within said first segment part of said first cross cut being formed by the cutting of said portion of the first blank within said first segment.

10. A method as in claim 1, wherein steps (f) and (g) are performed substantially simultaneously so as to continuously support said partial contour of said first blank while it is being transferred from said first pallet to said second pallet.

11. A method as in claim 1, further comprising the step (j) of moving said first pallet downstream simultaneously with step (h), so as to remove any completely cut blanks of said first segment from the cutting area.

12. A method as in claim 11, wherein step (j) includes the step of pushing the first pallet downstream with the second pallet.

13. A method as in claim 11, wherein in steps (h) and (j), the first and second pallets are moved at substantially the same speed and with substantially no space between them so as to continuously support said web.

14. A method as in claim 1, wherein steps (f) and (g) include the step of pushing the first pallet downstream with the second pallet.

15. A method as in claim 1, wherein step (c) comprises the steps of: (c) (1) employing a moveable clamp to clamp with web to a downstream end of said first pallet near a web-laying station; and then (c) (2) moving said first pallet into said cutting area while the clamp is still clamping the web to the downstream end of the first pallet.

16. A method as in claim 15, further comprising the step of releasing said moveable clamp from said web and moving it upstream to near said web-laying station.

17. A method as in claim 16, wherein step (f) is preceded by the step of clamping the web with a stationary clamp near a web-laying station to hold the web stationary while the second pallet moves downstream with respect to the web.

18. A method as in claim 17, wherein prior to step (h), the moveable clamp clamps the web to the second pallet, and the stationary clamp releases the web, to cause the second segment and the partial cut portion of the first blank to be carried into the cutting area by the second pallet.

19. A method as in claim 1, wherein the first and second pallets are moved substantially at the same speed in steps (f) and (g).

20. A method as in claim 19, wherein in steps (f) and (g) the first and second pallets are arranged with substantially no space between them so as to continuously support said web.

21. A method as in claim 1, wherein a second blank is defined completely within said second segment and is completely cut out in said second cutting step.

* * * * *